US009353328B2

(12) United States Patent
Miyamoto et al.

(10) Patent No.: US 9,353,328 B2
(45) **Date of Patent: *May 31, 2016**

(54) LUBRICATING OIL COMPOSITION

(75) Inventors: Hiroya Miyamoto, Tokyo (JP); Shigeki Matsui, Tokyo (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 49 days.

This patent is subject to a terminal disclaimer.

(21) Appl. No.: 14/114,549

(22) PCT Filed: Jan. 20, 2012

(86) PCT No.: PCT/JP2012/051218

§ 371 (c)(1),
(2), (4) Date: Oct. 29, 2013

(87) PCT Pub. No.: WO2012/153548

PCT Pub. Date: Nov. 15, 2012

(65) Prior Publication Data

US 2014/0113848 A1 Apr. 24, 2014

(30) Foreign Application Priority Data

May 6, 2011 (JP) ..... 2011-103695

(51) Int. Cl.

| | |
|---|---|
| ***C10M 105/04*** | (2006.01) |
| ***C10M 145/14*** | (2006.01) |
| ***C10M 171/02*** | (2006.01) |
| ***C10M 169/04*** | (2006.01) |

(52) U.S. Cl.

CPC ..... *C10M 145/14* (2013.01); *C10M 169/041* (2013.01); *C10M 171/02* (2013.01); *C10M 2203/1025* (2013.01); *C10M 2209/084* (2013.01); *C10M 2219/068* (2013.01); *C10M 2223/045* (2013.01); *C10M 2227/066* (2013.01); *C10N 2210/06* (2013.01); *C10N 2220/021* (2013.01); *C10N 2220/022* (2013.01); *C10N 2230/02* (2013.01); *C10N 2230/04* (2013.01); *C10N 2230/43* (2013.01); *C10N 2230/54* (2013.01); *C10N 2230/68* (2013.01); *C10N 2230/74* (2013.01); *C10N 2240/10* (2013.01); *C10N 2240/201* (2013.01)

(58) Field of Classification Search

CPC ..... C10M 105/04; C10M 2203/003; C10M 2203/0206; C10M 2205/003; C10M 2290/02

USPC ..... 208/18, 19

See application file for complete search history.

(56) References Cited

U.S. PATENT DOCUMENTS

| | | | | |
|---|---|---|---|---|
| 7,846,880 | B2 * | 12/2010 | Rosenbaum et al. | 508/110 |
| 8,193,129 | B2 * | 6/2012 | Tagawa et al. | 508/133 |
| 8,227,385 | B2 * | 7/2012 | Tagawa et al. | 508/110 |
| 8,563,486 | B2 * | 10/2013 | Tsujimoto et al. | 508/110 |
| 8,642,517 | B2 * | 2/2014 | Matsui et al. | 508/110 |
| 8,648,021 | B2 * | 2/2014 | Tagawa et al. | 508/469 |
| 8,703,663 | B2 * | 4/2014 | Tagawa | 508/110 |
| 8,754,016 | B2 * | 6/2014 | Tagawa et al. | 508/110 |
| 8,846,589 | B2 * | 9/2014 | Matsuoka et al. | 508/225 |
| 2008/0153721 | A1 | 6/2008 | Rosenbaum et al. | |
| 2011/0003725 | A1 | 1/2011 | Matsui et al. | |

FOREIGN PATENT DOCUMENTS

| | | | |
|---|---|---|---|
| EP | 2319908 | A1 | 5/2011 |
| EP | 2439258 | A1 | 4/2012 |
| JP | H06-306384 | A | 11/1994 |
| JP | H08-302378 | A | 11/1996 |
| JP | 2001-279287 | A | 10/2001 |
| JP | 2002-129182 | A | 5/2002 |
| JP | 2009-167278 | A | 7/2009 |
| JP | 2009-191247 | A | 8/2009 |
| JP | 2010-513696 | A | 4/2010 |
| WO | 2010010807 | A1 | 1/2010 |
| WO | 2010041689 | A1 | 4/2010 |
| WO | 2010140446 | A1 | 12/2010 |

OTHER PUBLICATIONS

Extended European Search Report issued Oct. 17, 2014 in EP Application No. 12781597.5.

Int'l Search Report issued Apr. 24, 2012 in Int'l Application No. PCT/JP2012/051218.

* cited by examiner

*Primary Examiner* — Ellen McAvoy

(74) *Attorney, Agent, or Firm* — Panitch Schwarze Belisario & Nadel LLP

(57) ABSTRACT

The present invention provides a lubricating oil composition for an internal combustion engine used mainly to drive a generator and to improve the fuel economy thereof. The composition comprises (A) a base oil being a hydrocarbon base oil having a ratio (CA/CB) of the proportion of the component of 24 or fewer carbon atoms (CA) and the proportion of the component of 25 or more carbon atoms (CB) in the carbon number distribution obtained by gas chromatography distillation of 2.0 or higher, the composition having a ratio (Vs/Vk) of the 80° C. high-temperature high-shear (HTHS) viscosity (Vk) and the 150° C. HTHS viscosity (Vs) of 0.35 or higher and a 100° C. kinematic viscosity of 2.5 $mm^2/s$ or higher and 5.2 $mm^2/s$ or lower.

4 Claims, No Drawings

LUBRICATING OIL COMPOSITION

CROSS-REFERENCE TO RELATED APPLICATIONS

This application is a Section 371 of International Application No. PCT/JP2012/051218, filed on Jan. 20, 2012, which was published in the Japanese language on Nov. 15, 2012, under International Publication No. WO 2012/153548 A1, and the disclosure of which is incorporated herein by reference.

TECHNICAL FIELD

The present invention relates to lubricating oil composition.

BACKGROUND ART

Conventionally, lubricating oil has been used in an internal combustion engine, a transmission or other mechanical devices to allow the smooth operation thereof. In particular, a lubricating oil (engine oil) for an internal combustion engine is required to have high performances because the internal combustion engine has been improved in performance, enhanced in output and used under severe working conditions. Therefore, it is indispensable for the engine oil to maintain viscosity at high temperatures. In order to meet such demands, conventional engine oils contain various additives such as an antiwear agent, a metallic detergent, an ashless dispersant, and an anti-oxidant (for example, see Patent Literatures 1 to 3 below).

Furthermore, recently the fuel saving performance of the lubricating oil has been required to be better and better, and thus applications of a high viscosity index base oil or various friction modifiers have been studied (for example, see Patent Literature 4 below).

By the way, a system for generating electric power utilizing an internal combustion engine as a means for providing driving force has existed through the ages. However, no concern has been made for the fuel economy provided by the lubricating oil used in this system so far.

However, some automobiles such as hybrid cars have been equipped with a motor used to provide part of driving force and the engine has been used to drive the motor when used as a generator or drive both the motor and generator rather than to provide the automobiles with driving force.

CITATION LIST

Patent Literature

Patent Literature 1: Japanese Patent Application Publication No. 2001-279287

Patent Literature 2: Japanese Patent Application Publication No. 2002-129182

Patent Literature 3: Japanese Patent Application Laid-Open Publication No. 08-302378

Patent Literature 4: Japanese Patent Application Laid-Open Publication No. 06-306384

SUMMARY OF INVENTION

Technical Problem

The conventional lubricating oil for the engine of a motor-driven hybrid cars is of fuel economy type but is still on the same technical field as the conventional engine oils.

As a typical technique for improving fuel economy, multi-grading is known that is a combination of a reduction in kinematic viscosity and an enhancement in viscosity index that is of a reduction in the base oil viscosity and addition of a viscosity index improver. However, a reduction in the product viscosity or the base oil viscosity degrades lubricating properties under sever lubricating conditions (high temperature and high shear conditions), and thus has been concerned to cause defects such as wear, seizure, or fatigue breaking.

In order to prevent these defects and maintain the durability of an engine, high temperature high shear viscosity (HTHS viscosity) at 150° C. need to be retained. More specifically, a lubricating oil importantly retains the 150° C. HTHS viscosity and reduces the 40° C. and 100° C. kinematic viscosities or the 100° C. HTHS viscosity thereby enhancing the viscosity index in order to provide an engine with improved fuel economy, retaining the practical performances thereof.

Alternatively, a lubricating oil may be enhanced in low temperature performances by reducing the 40° C. and 100° C. kinematic viscosities or the base oil viscosity, and adding the viscosity index improver to be multi-graded. However, a reduction in the product viscosity or base oil viscosity degrades the lubricating performance under sever lubricating conditions (high temperature high shear conditions), and thus has been concerned to cause defects such as wear, seizure, or fatigue breaking, resulting in a limited improvement in fuel economy.

The present invention was made in view of the current conditions and intends to provide a lubricating oil composition for an internal combustion engine for mainly driving a generator, improving the fuel economy thereof.

Solution to Problem

That is, the present invention relates to a lubricating oil composition comprising (A) a base oil being a hydrocarbon base oil having a ratio (CA/CB) of the proportion of the component of 24 or fewer carbon atoms (CA) and the proportion of the component of 25 or more carbon atoms (CB) in the carbon number distribution obtained by gas chromatography distillation of 2.0 or greater, the composition having a ratio (Vs/Vk) of the 80° C. high-temperature high-shear (HTHS) viscosity (Vk) and the 150° C. HTHS viscosity (Vs) of 0.35 or higher and a 100° C. kinematic viscosity of 2.5 $mm^2/s$ or higher and lower than 5.2 $mm^2/s$ or lower.

The present invention also relates to the foregoing lubricating oil composition comprising (B) a viscosity index improver having a ratio of the weight-average molecular weight and the PSSI of $1.2\times10^4$ or greater.

The present invention relates to the foregoing lubricating oil composition which is an engine oil for a generator.

Advantageous Effect of Invention

The lubricating oil composition of the present invention is excellent in fuel saving properties and still retains 150° C. HTHS viscosity that affects the durability of an engine, and thus makes it possible to retain the durability of an engine, allowing the engine to exhibit a significantly improved fuel economy.

DESCRIPTION OF EMBODIMENTS

The present invention will be described in more detail below.

In the lubricating oil composition of the present invention, the base oil thereof is a hydrocarbon base oil having a ratio (CA/CB) of the proportion of the component of 24 or fewer carbon atoms (CA) and the proportion of the component of 25 or more carbon atoms (CB) in the carbon number distribution obtained by gas chromatography distillation of 2.0 or higher (hereinafter referred to as "lubricating base oil of the present invention"). The CA/CB is preferably 2.5 or higher, more preferably 3 or higher, most preferably 5 or higher. A base oil with a CA/CB of lower than 2.0 cannot provide the resulting composition with a sufficiently low 80° C. high-temperature high-shear (HTHS) viscosity.

The base oil is preferably a hydrocarbon base oil having a ratio (CC/CD) of the proportion of the component of 18 or fewer carbon atoms (CC) and the proportion of the component of 19 or more carbon atoms (CD) in the carbon number distribution obtained by gas chromatography distillation of 0.3 or lower. The CC/CD is preferably 0.25 or lower, more preferably 0.2 or lower, most preferably 0.1 or lower. A base oil having a CC/CD of higher than 0.3 is not preferable because the consumption of the resulting lubricating oil is increased also in the intended engine for an generator.

The gas chromatography distillation referred herein was carried out in the following conditions:

Model: GC-2010 manufactured by Shimadzu Corporation
Column: Ultra alloy-1HT (30 mm×0.25 mmΦ)
Carrier gas: helium 200 kPa
Detector: FID
Det. Temp.: 350° C.
Oven Temp.: 80° C. to 320° C. (5 min)
Temp. Rate: 5° C./min
Inj. Vol.: 1 μL toluene solution The lubricating base oil of the present invention may be any of the mineral base oils satisfying the requirement that is the ratio (CA/CB) of the proportion of the component of 24 or fewer carbon atoms (CA) and the proportion of the component of 25 or more carbon atoms (CB) in the carbon number distribution is 2.0 or higher, selected from hydrocarbon base oils which can be produced by subjecting a lubricating oil fraction produced by atmospheric- and/or vacuum-distillation of a crude oil, to any one of or any suitable combination of refining processes selected from solvent deasphalting, solvent extraction, hydrocracking, solvent dewaxing, catalytic dewaxing, hydrorefining, sulfuric acid treatment, and clay treatment.

Alternatively, the base oil may be any of the synthetic lubricating base oils satisfying the requirement that is the ratio (CA/CB) of the proportion of the component of 24 or fewer carbon atoms (CA) and the proportion of the component of 25 or more carbon atoms (CB) in the carbon number distribution is 2.0 or higher.

Further alternatively, the base oil may be a mixture of a mineral base oil and a synthetic lubricating oil (synthetic base oil), both meeting this requirement.

Examples of preferred mineral lubricating base oils include base oils produced using the following base oils (1) to (8) as a feedstock by refining the feedstock and/or a lubricating oil fraction recovered therefrom in a given process and recovering a lubricating oil fraction:

(1) a distillate oil produced by atmospheric distillation of a paraffin base crude oil and/or a mixed base crude oil;

(2) a whole vacuum gas oil (WVGO) produced by vacuum distillation of the topped crude of a paraffin base crude oil and/or a mixed base crude oil;

(3) a wax produced by a lubricating oil dewaxing process and/or a Fischer-Tropsch wax produced by a GTL process;

(4) an oil produced by mild-hydrocracking (MHC) one or more oils selected from oils of (1) to (3) above;

(5) a mixed oil of two or more oils selected from (1) to (4) above;

(6) a deasphalted oil (DA0) produced by deasphalting an oil of (1), (2) (3), (4) or (5);

(7) an oil produced by mild-hydrocracking (MHC) an oil of (6); and (8) a lubricating oil produced by subjecting a mixed oil of two or more oils selected from (1) to (7) used as a feed stock and/or a lubricating oil fraction recovered therefrom to a normal refining process and further recovering a lubricating oil fraction from the refined product.

The above-mentioned given refining process is preferably hydro-refining such as hydrocracking or hydrofinishing, solvent refining such as furfural extraction, dewaxing such as solvent dewaxing and catalytic dewaxing, clay refining with acidic clay or active clay or chemical (acid or alkali) refining such as sulfuric acid treatment and sodium hydroxide treatment. In the present invention, any one or more of these refining processes may be used in any combination and order.

The lubricating base oil used in the present invention is particularly preferably the following base oil (9) or (10) produced by subjecting a base oil selected from the above-described base oils (1) to (8) or a lubricating oil fraction recovered therefrom to a specific treatment:

(9) a hydrocracked mineral oil produced by hydrocracking a base oil selected from the base oils (1) to (8) or a lubricating oil fraction recovered from the base oil, and subjecting the resulting product or a lubricating oil fraction recovered therefrom by distillation, to a dewaxing treatment such as solvent or catalytic dewaxing, optionally followed by distillation; or

(10) a hydroisomerized mineral oil produced by hydroisomerizing a base oil selected from the base oils (1) to (8) or a lubricating oil fraction recovered from the base oil, and subjecting the resulting product or a lubricating oil fraction recovered therefrom by distillation, to a dewaxing treatment such as solvent or catalytic dewaxing, optionally followed by distillation.

If necessary, a solvent refining process and/or a hydrofinishing process may be carried out at appropriate timing upon production of the lubricating base oil (9) or (10).

The 100° C. kinematic viscosity of the mineral base oil used in the present invention is preferably 4.5 $mm^2/s$ or lower, more preferably 4 $mm^2/s$ or lower, more preferably 3.5 $mm^2/s$ or lower, most preferably 3 $mm^2/s$ or lower. Whilst, the 100° C. kinematic viscosity is preferably 1 $mm^2/s$ or higher, more preferably 1.5 $mm^2/s$ or higher, more preferably 2 $mm^2/s$ or higher, most preferably 2.3 $mm^2/s$ or higher.

The 100° C. kinematic viscosity referred herein denotes the viscosity defined by ASTM D-445. If the 100° C. kinematic viscosity of the lubricating base oil is higher than 4.5 $mm^2/s$, the resulting composition could fail to obtain sufficiently improved fuel economy. If the 100° C. kinematic viscosity is lower than 1 $mm^2/s$, the resulting lubricating oil composition would be poor in lubricity due to its insufficient oil film formation at lubricating sites and would be large in evaporation loss of the composition.

In the present invention, a mineral base oil having a 100° C. kinematic viscosity in the following range is preferably separated by distillation or the like and then used:

(I) a mineral oil having a 100° C. kinematic viscosity of 1 $mm^2/s$ or higher, preferably 2.3 $mm^2/s$ or higher, and lower than 3 $mm^2/s$, preferably 2.9 $mm^2/s$ or lower; and (II) a mineral base oil having a 100° C. kinematic viscosity of 3 $mm^2/s$ or higher, preferably 3.5 $mm^2/s$ or higher and 4.5 $mm^2/s$ or lower, preferably 4.0 $mm^2/s$ or lower.

In the present invention, a mixture of the above mineral base oils (I) and (II) may be used but the mineral base oil (I) is preferably used alone.

The viscosity index of the mineral base oil used in the present invention is preferably 90 or more, more preferably 105 or more, more preferably 110 or more and preferably 160 or less.

The viscosity index of the mineral base oil (I) is preferably 90 or more, more preferably 105 or more, more preferably 110 or more, most preferably 120 or more and preferably 160 or less.

The viscosity index of the mineral base oil (II) is preferably 110 or more, more preferably 120 or more, more preferably 130 or more, most preferably 140 or more and preferably 160 or less.

If the viscosity index is less than 90, the resulting composition would not only be degraded in viscosity-temperature characteristics, thermal and oxidation stability, and anti-volatile properties but also tend to be increased in friction coefficient and thus degraded in anti-wear properties. If the viscosity index exceeds 160, the resulting composition would tend to be degraded in low temperature viscosity characteristics.

The viscosity index referred herein denotes the one measured in accordance with JIS K 228 3-1993.

The 15° C. density (ρ15) of the mineral base oil used in the present invention depends on the viscosity grade of the lubricating base oil component but is preferably a value of ρ or less represented by the following formula, i.e., ρ15≤ρ:

$$\rho=0.0025\times kv100+0.816$$

wherein kv100 is the 100° C. kinematic viscosity ($mm^2/s$) of the lubricating base oil component.

If ρ15>ρ, the resulting composition would tend to be degraded in viscosity-temperature characteristics and thermal oxidation stability as well as anti-volatile properties and low temperature viscosity characteristics and thus degrade the fuel economy. Furthermore, if the lubricating base oil component contains additives, the effects thereof would be reduced.

Specifically, the 15° C. density (ρ15) of the mineral base oil used in the present invention is preferably 0.835 or lower, more preferably 0.828 or lower, more preferably 0.822 or lower, particularly preferably 0.815 or lower, most preferably 0.805 or lower and preferably 0.785 or higher. The 15° C. density referred in the present invention denotes the density measured at 15° C. in accordance with JIS K 2249-1995.

The pour point of the mineral base oil used in the present invention is preferably −10° C. or lower, more preferably −15° C. or lower, more preferably −17.5° C. or lower. The pour point of the above-described lubricating base oils (I) and (II) is preferably −15° C. or lower, more preferably −17.5° C. or lower, more preferably −20° C. or lower. If the pour point is higher than −10° C., the whole lubricating oil containing such a lubricating base oil would tend to be degraded in low temperature fluidity. The pour point referred in the present invention is the pour point measured in accordance with JIS K 2269-1987.

The aniline point (AP) of the above-described mineral base oil is preferably 95° C. or higher, more preferably 105° C. or higher, most preferably 110° C. or higher, and preferably 130° C. or lower. If the aniline point is lower than 95° C., the resulting composition would be degraded in adoptability to rubber materials such as sealing materials. If the aniline point is higher than 130° C., the mineral oil would be insufficient in dissolubity of additives. The aniline point referred in the present invention denotes the aniline point measured in accordance with JIS K 2256-1985.

The sulfur content of the mineral base oil used in the present invention depends on the sulfur content of the raw material thereof. For example, when a raw material containing substantially no sulfur such as a synthetic wax component produced by Fischer-Tropsch reaction is used, a lubricating base oil containing substantially no sulfur can be produced. Alternatively, when a raw material containing sulfur such as slack wax produced through a refining process of a lubricating base oil or micro wax produced through wax refining is used, the sulfur content of the resulting lubricating base oil is usually 100 mass ppm or more. The sulfur content of the lubricating base oil used in the present invention is preferably 100 mass ppm or less, more preferably 50 mass ppm or less, more preferably 10 mass ppm or less, particularly preferably 5 mass ppm or less with the objective of further improving thermal oxidation stability and lowering the sulfur content.

No particular limitation is imposed on the nitrogen content of the mineral base oil used in the present invention, which is, however, preferably 7 mass ppm or less, more preferably 3 mass ppm or less, more preferably containing no nitrogen. If the nitrogen content exceeds 7 mass ppm, the resulting composition would tend to be degraded in thermal oxidation stability. The nitrogen content referred in the present invention denotes the nitrogen content measured in accordance with JIS K 2609-1990.

The % $C_P$ of the mineral base oil used in the present invention is preferably 70 or greater, more preferably 80 to 99, more preferably 85 to 95, particularly preferably 87 to 94, most preferably 90 to 94. If the % $C_P$ of the lubricating base oil is less than 70, the resulting composition would tend to be degraded in viscosity-temperature characteristics, thermal oxidation stability and friction characteristics and when blended with additives, would tend to be reduced in the effect thereof. The upper limit of % $C_P$ of the lubricating base oil affects the dissolubility of additives and thus if it is too high, the base oil may not dissolve some of the additives depending on the type thereof.

The % $C_A$ of the mineral base oil used in the present invention is preferably 2 or less, more preferably 1 or less, more preferably 0.8 or less, particularly preferably 0.5 or less, most preferably 0. If the % $C_A$ of the lubricating base oil exceeds 2, the resulting composition would tend to be degraded in viscosity-temperature characteristics, thermal oxidation stability and fuel economy.

The % $C_N$ of the mineral base oil used in the present invention is preferably 40 or less, more preferably 35 or less, more preferably 20 or less, most preferably 10 or less and preferably 3 or greater. If the % $C_N$ of the lubricating base oil exceeds 40, the resulting composition would tend to be degraded in viscosity-temperature characteristics, thermal oxidation stability and friction characteristics. If the % CN is less than 3, the mineral base oil would tend to be reduced in dissolubiluty of additives.

The % $C_P$, % $C_N$, and % $C_A$ referred in the present invention denote the percentage of paraffin carbon number in the total carbon number, the percentage of naphthene carbon number in the total carbon number, and the percentages of the aromatic carbon number in the total carbon number, respectively, determined by a method (n-d-M ring analysis) in accordance with ASTM D 3238-85. Specifically, the above-described preferred ranges of the % $C_P$, % $C_N$ and % $C_A$ are based on the values determined by the above-described method, and for example, even if a lubricating base oil does not contain naphthene, the % CN may represent the value of exceeding 0.

No particular limitation is imposed on the saturate content of the lubricating base oil used in the present invention if the carbon number distribution satisfies the above-described conditions. However, the saturate content is preferably 90 percent by mass or more, preferably 95 percent by mass or more, more preferably 99 percent by mass or more on the basis of the total mass of the lubricating base oil. Satisfying this condition can provide a lubricating oil composition that can be enhanced in viscosity-temperature characteristics and thermal oxidation stability. Furthermore, according to the present invention, the lubricating base oil itself can be improved in friction characteristics and as the result improved in friction reducing effect and moreover achieve the improvement in fuel economy.

The saturate content referred in the present invention is measured in accordance with the method described in the aforesaid ASTM D 2007-93. Upon separation of the saturate or analysis of the cyclic saturate and non-cyclic saturate, similar methods that can provide similar results can be used. Examples of such methods include the methods described in ASTM D 2425-93 and ASTM D 2549-91, a method using high-performance liquid chromatography (HPLC) and methods obtained by improving these methods.

No particular limitation is imposed on the aromatic content of the mineral base oil used in the present invention if the conditions of the 100° C. kinematic viscosity, % $C_P$ and % $C_A$ are satisfied. However, the aromatic content is preferably 5 percent by mass or less, more preferably 4 percent by mass or less, more preferably 3 percent by mass or less, particularly preferably 2 percent by mass or less, most preferably 0 on the basis of the total mass of the lubricating base oil. If the aromatic content exceeds 5 percent by mass, the resulting composition would tend to be degraded in viscosity-temperature characteristics, thermal oxidation stability and friction characteristics, and furthermore in anti-volatile properties and low temperature viscosity characteristics and when blended with additives, would tend to reduce the effects thereof.

The aromatic content referred herein denotes the value measured in accordance with ASTM D 2007-93. The aromatics includes alkylbenzenes; alkylnaphthalens; anthracene, phenanthrene, and alkylated products thereof; compounds wherein four or more benzene rings are condensated to each other; and compounds having hetero atoms such as pyridines, quinolines, phenols, and naphthols.

Examples of synthetic lubricating base oils which may be used in the present invention include poly-α-olefins and hydrogenated compounds thereof; isobutene oligomers and hydrogenated compounds thereof; paraffins; alkylbenzenes; alkylnaphthalenes; diesters such as ditridecyl glutarate, di-2-ethylhexyl adipate, diisodecyl adipate, ditridecyl adipate and di-2-ethylhexyl sebacate; polyol esters such as trimethylolpropane caprylate, trimethylolpropane pelargonate, pentaerythritol 2-ethylhexanoate and pentaerythritolpelargonate; polyoxyalkylene glycols; dialkyldiphenyl ethers; and polyphenyl ethers. Preferred synthetic lubricating base oils are poly-α-olefins. Typical examples of poly-α-olefins include oligomers or cooligomers of α-olefins having 2 to 32, preferably 6 to 16 carbon atoms, such as 1-octene oligomer, decene oligomer, ethylene-propylene cooligomer, and hydrogenated compounds thereof.

No particular limitation is imposed on the method of producing poly-α-olefins. For example, poly-α-olefins may be produced by polymerizing α-olefins in the presence of a polymerization catalyst such as a Friedel-Crafts catalyst containing aluminum trichloride, or a complex of boron trifluoride with water, an alcohol such as ethanol, propanol and butanol, a carboxylic acid or an ester.

The 100° C. kinematic viscosity of the synthetic lubricating oil used in the present invention is preferably 4.5 $mm^2/s$ or lower, more preferably 3.5 $mm^2/s$ or lower, more preferably 3 $mm^2/s$ or lower, particularly preferably 2.5 $mm^2/s$ or lower, most preferably 2 $mm^2/s$ or lower. The 100° C. kinematic viscosity is preferably 1 $mm^2/s$ or higher, more preferably 1.5 $mm^2/s$ or higher.

If the 100° C. kinematic viscosity of the synthetic lubricating oil exceeds 4.5 $mm^2/s$, a sufficient fuel economy may not be obtained. If the 100° C. kinematic viscosity the is lower than 1 $mm^2/s$, the resulting lubricating oil composition would be poor in lubricity due to its insufficient oil film formation at lubricating sites and would be large in evaporation loss of the composition.

The viscosity index of the synthetic lubricating oil used in the present invention is preferably 90 or more, more preferably 93 or more. The viscosity index of the synthetic lubricating oil is preferably 130 or less. If the viscosity index is less than 90, the resulting composition would not only be degraded in viscosity-temperature characteristics, thermal oxidation stability, anti-volatile properties but also tend to be increased in friction coefficient and degraded in anti-wear properties. It is difficult to provide a synthetic lubricating oil having a viscosity index exceeding 130 due to viscosity characteristic.

The above-described mineral base oil or synthetic base oil may be used alone or in combination as the lubricating base oil used in the present invention. Alternatively, the mineral base oil and/or synthetic base oil used in the present invention may be used in combination with one or more other base oils. When the other base oils are used in combination, the proportion of the mineral base oil and/or synthetic base oil in the base oil of the present invention is preferably 30 percent by mass or greater, more preferably 50 percent by mass or greater, more preferably 70 percent by mass or greater.

No particular limitation is imposed on the other base oil used in combination with the mineral base oil, synthetic base oil or a mixed base oil thereof used in the present invention. Examples of such base oils include synthetic oils and mineral base oils, having a 100° C. kinematic viscosity of 1 to 100 $mm^2/s$ and not satisfying the condition of CA/CB of 2.0 or greater. The compounds and types are the same as those described above.

The flash point of the lubricating base oil used in the present invention is preferably 145° C. or higher, more preferably 150° C. or higher, more preferably 180° C. or higher, most preferably 190° C. or higher and preferably 250° C. or lower. A too low flash point is not preferred because it increases the risk of ignition and the evaporation loss of the resulting composition. A flash point higher than the upper limit causes a too high viscosity and thus the fuel economy effect cannot be seen. The flash point referred herein is the value measured in accordance with JIS K 2265.

No particular limitation is imposed on the NOACK evaporation loss of the lubricating base oil used in the present invention measured under the test condition of 250° C., which is, however, preferably 70 percent by mass or less, more preferably 50 percent by mass or less and preferably 5 percent by mass or more. If the NOACK evaporation loss is less than 5 percent by mass, too many base oils of high molecular weight remain and thus it would be difficult to improve the low temperature viscosity characteristics.

In particular, under the test condition of 200° C., the NOACK evaporation loss is 40 percent by mass or less. The NOACK evaporation loss is more preferably 30 percent by mass or less, more preferably 10 percent by mass or less. If the 200° C. NOACK evaporation loss exceeds 40 percent by mass, the lubricating base oil would be large in the evaporation loss when it is used in a lubricating oil for an internal combustion engine primary for generating a generator and in connection with this facilitate catalyst poisoning. The NOACK evaporation loss referred in the present invention denotes the evaporation loss measured in accordance with ASTM D 580-95.

The viscosity index improver (Component (B)) contained in the lubricating oil composition of the present invention is preferably a poly(meth)acrylate-based additive substantially containing a structural unit derived from a monomer represented by formula (1) below.

(1)

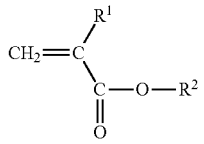

In formula (1), $R^1$ is hydrogen or methyl, preferably methyl, and $R^2$ is a hydrocarbon group having 1 to 30 carbon atoms.

Specific examples of the hydrocarbon group having 1 to 30 carbon atoms include alkyl groups having 1 to 30 carbon atoms, such as methyl, ethyl, n-propyl, isopropyl, n-butyl, isobutyl, sec-butyl, tert-butyl, straight-chain or branched pentyl, straight-chain or branched hexyl, straight-chain or branched heptyl, straight-chain or branched octyl, straight-chain or branched nonyl, straight-chain or branched decyl, straight-chain or branched undecyl, straight-chain or branched dodecyl, straight-chain or branched tridecyl, straight-chain or branched tetradecyl, straight-chain or branched pentadecyl, straight-chain or branched hexadecyl, straight-chain or branched heptadecyl, straight-chain or branched octadecyl, straight-chain or branched nonadecyl, straight-chain or branched eicosyl, straight-chain or branched heneicosyl, straight-chain or branched docosyl, straight-chain or branched tricosyl, straight-chain or branched tetracosyl groups.

Component (B) used in the present invention may contain a structural unit derived from a monomer represented by formula (2) or (3) below.

(2)

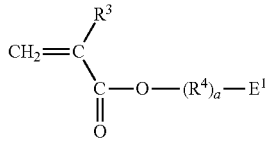

In formula (2), $R^3$ is hydrogen or methyl, $R^4$ is an alkylene group having 1 to 30 carbon atoms, $E^1$ is an amine residue or heterocyclic residue having 1 or 2 nitrogen atoms and 0 to 2 oxygen atoms, and a is an integer of 0 or 1.

(3)

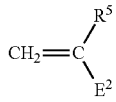

In formula (3), $R^5$ is hydrogen or methyl, and $E^2$ is an amine residue or heterocyclic residue having 1 or 2 nitrogen atoms and 0 to 2 oxygen atoms.

Specific examples of the groups represented by $E^1$ and $E^2$ include dimethylamino, diethylamino, dipropylamino, dibutylamino, anilino, toluidino, xylidino, acetylamino, benzoilamino, morpholino, pyrrolyl, pyrrolino, pyridyl, methylpyridyl, pyrrolidinyl, piperidinyl, quinonyl, pyrrolidonyl, pyrrolidono, imidazolino and pyrazino groups.

Preferred examples include dimethylaminomethyl methacrylate, diethylaminomethyl methacrylate, dimethylaminoethyl methacrylate, diethylaminoethyl methacrylate, 2-methyl-5-vinyl pyridine, morpholinomethyl methacrylate, morpholinoethyl methacrylate, N-vinyl pyrrolidone and mixtures thereof.

Specific examples of Component (B) include copolymers of monomers (Ba) to (Bd) represented by formula (1) and polar group-containing monomers (Be) represented by formula (2) and/or (3) used if necessary:

(Ba) (meth)acrylates wherein $R^2$ is an alkyl group of 1 to 4 carbon atoms;

(Bb) (meth)acrylate wherein $R^2$ is an alkyl group of 5 to 10 carbon atoms;

(Bc) (meth)acrylates wherein $R^2$ is an alkyl group of 12 to 18 carbon atoms;

(Bd) (meth)acrylate wherein $R^2$ is an alkyl group of 20 or more carbon atoms; and (Be) polar group-containing monomers.

The structural ratio of the monomers in Component (B) that is the viscosity index improver used in the present invention is preferably the following ratio on the basis of the total amount of the monomers constituting the poly(meth)acrylate:

Component (Ba): preferably 25 mol % or more, more preferably 45 mol % or more, more preferably 65 mol % or more, and preferably 95 mol % or less, more preferably 90 mol % or less, more preferably 85 mol % or less;

Component (Bb): preferably 0 mol % or more and preferably 50 mol % or less, more preferably 20 mol % or less;

Component (Bc): preferably 0 mol % or more, more preferably 5 mol % or more, more preferably 10 mol % or more and preferably 60 mol % or less, more preferably 45 mol % or less, more preferably 30 mol % or less;

Component (Bd): preferably 1 mol % or more, more preferably 3 mol % or more, more preferably 5 mol % or more and preferably 55 mol % or less, more preferably 35 mol % or less, more preferably 15 mol % or less; and Component (Be): preferably 0 mol % or more and preferably 20 mol % or less, more preferably 10 mol % or less, more preferably 5 mol % or less.

With this formulation, the resulting composition can achieve the ratio of the weight-average molecular weight and PSSI that is $1.2\times10^4$ or greater.

No particular limitation is imposed on the method for producing the above-described poly(meth)acrylate. For example, it can be easily produced by the radical-solution polymerization of a mixture of monomers (Ba) to (Be) in the presence of a polymerization initiator such as benzoyl peroxide.

The weight-average molecular weight (MW) of Component (B) that is the viscosity index improver is necessarily 50,000 or greater, preferably 70,000 or greater, more preferably 100,000 or greater, particularly preferably 150,000 or greater. The weight-average molecular weight (MW) is preferably 1,000,000 or less, more preferably 700,000 or less, more preferably 600,000 or less, particularly preferably 500,000 or less. If Component (B) has a weight-average molecular weight of less than 50,000, it would be less in the effect of enhancing viscosity temperature characteristics or viscosity index and thus would increase the cost. If Component (B) has a weight-average molecular weight of greater than 1,000,000, it would degrade shear stability, dissolubility to the base oil, and storage stability.

The weight-average molecular weight used herein denotes a weight-average molecular weight on polystyrene basis determined with a differential refractive index detector ($R^1$) at a temperature of 23° C., a flow rate of 1 mL/min, a sample concentration of 1 percent by mass, and a sample injection amount of 75 μL, using 150-C ALC/GPC manufactured by Waters having two columns GMHHR-M (7.8 mm ID×30 cm) equipped in series therein and tetrahydrofuran as a solvent.

The PSSI of Component (B) is preferably 40 or less, more preferably 30 or less, more preferably 20 or less. If Component (B) has a PSSI of greater than 40, the resulting composition would be degraded in shear stability and also low temperature viscosity characteristics.

The term "PSSI" used herein denotes the permanent shear stability index of a polymer calculated on the basis of the data measured with ASTM D 6278-02 (Test Method for Shear Stability of Polymer Containing Fluids Using a European Diesel Injector Apparatus) in conformity with ASTM D 6022-01 (Standard Practice for Calculation of Permanent Shear Stability Index).

The ratio of the weight-average molecular weight and PSSI (MW/PSSI) in Component (B) is necessarily $1.2\times10^4$ or greater, preferably $1.5\times10^4$ or greater, more preferably $2\times10^4$ or greater, more preferably $2.5\times10^4$ or greater, particularly preferably $3\times10^4$ or greater. When the MW/PSSI is less than $1.2\times10^4$, a sufficient fuel economy cannot be attained.

The MW/PSSI has an upper limit of $20\times10^4$, and is preferably $20\times10^4$ or less, more preferably $10\times10^4$ or less. Although a higher MW/PSSI is better, there is a limit thereof because when Component (B) is increased in molecular weight, the resulting composition is susceptible to shear.

The content of Component (B) of the lubricating oil composition of the present invention is 2 percent by mass or more, preferably 4 percent by mass or more, more preferably 7 percent by mass or more, more preferably 10 percent by mass or more. The content is preferably 40 percent by mass or less, more preferably 35 percent by mass or less, more preferably 30 percent by mass or less, most preferably 25 percent by mass or less on the total composition amount basis. When the content of Component (B) is less than 2 percent by mass, the effects of enhancing the viscosity index or lowering the viscosity would be small, possibly resulting in the risk of failing to improve the fuel economy. When the content is more than 40 percent by mass, the product cost is significantly increased and it calls for a decrease in base oil viscosity, possibly resulting in degraded lubricating performance under sever lubrication conditions (high temperature high shear condition), causing defects such as wear, seizure, fatigue breaking.

In addition to the above-described viscosity index improver, the lubricating oil composition of the present invention may further contain an ordinary conventional non-dispersant or dispersant type poly(meth)acrylates, a non-dispersant or dispersant type ethylene-α-olefin copolymers and hydrogenated compounds thereof, polyisobutylene and hydrogenated compounds thereof, styrene-diene hydrogenated copolymers, styrene-maleic anhydride ester copolymers, and polyalkylstyrenes.

The lubricating oil composition of the present invention may further contain a friction modifier selected from organic molybdenum compounds and ashless friction modifier so as to enhance fuel economy.

Examples of the organic molybdenum compound include sulfur-containing organic molybdenum compounds such as molybdenum dithiophosphate and molybdenum dithiocarbamate; complexes of molybdenum compounds (for example, molybdenum oxides such as molybdenum dioxide and molybdenum trioxide, molybdic acids such as orthomolybdic acid, paramolybdic acid, and sulfurized (poly)molybdic acid, metal salts of these molybdic acids, molybdic acid salts such as ammonium salts of these molybdic acids, molybdenum sulfides such as molybdenum disulfide, molybdenum trisulfide, molybdenum pentasulfide, and molybdenum polysulfide, sulfurized molybdenum acid, metal and amine salts of sulfurized molybdenum acid, and halogenated molybdenum such as molybdenum chloride) and sulfur-containing organic compounds (for example, alkyl(thio)xanthate, thiaziazole, mercaptothiadiazole, thiocarbonate, tetrahydrocarbylthiuramdisulfide, bis(di(thio) hydrocarbyldithiophosphonate)disulfide, organic (poly) sulfide, and sulfurized esters) or other organic compounds; complexes of sulfur-containing molybdenum compounds such as the above-mentioned molybdenum sulfides and sulfurized molybdenum acid and alkenyl succinicimide.

Alternatively, the organic molybdenum compound may be a sulfur free molybdenum compound. Examples of such a molybdenum compound include molybdenum-amine complexes, molybdenum-succinicimide complexes, molybdenum salts of organic acids, and molybdenum salts of alcohols, among which preferred are molybdenum-amine complexes, molybdenum salts of organic acids, and molybdenum salts of alcohols.

No particular limitation is imposed on the content of the organic molybdenum compound if contained in the lubricating oil composition of the present invention, which is, however, preferably 0.001 percent by mass or more, more preferably 0.005 percent by mass or more, more preferably 0.01 percent by mass or more, particularly preferably 0.03 percent by mass or more and preferably 0.2 percent by mass or less, more preferably 0.1 percent by mass or less, more preferably 0.08 percent by mass or less, particularly preferably 0.06 percent by mass or less on the basis of molybdenum on the total composition mass basis. If the content is less than 0.001 percent by mass, the resulting lubricating oil composition would be insufficient in thermal oxidation stability and in particular tend not to retain excellent detergency for along period of time. If the content exceeds 0.2 percent by mass, an advantageous effect as balanced with the content cannot be obtained, and the resulting lubricating oil composition would tend to be degraded in storage stability.

The ashless friction modifier which may be used in the present invention may be any compound that is usually used as a friction modifier for lubricating oils. Examples of such an ashless friction modifier include ashless friction modifiers such as amine compounds, fatty acid esters, fatty acid amides, fatty acids, aliphatic alcohols, and aliphatic ethers, each having at least one alkyl or alkenyl group having 6 to 30 carbon atoms, in particular straight-chain alkyl or alkenyl group having 6 to 30 carbon atoms per molecule. Alternatively, the ashless friction modifier may be one or more type of compound selected from nitrogen-containing compounds and acid-modified derivatives thereof or various ashless friction modifiers as exemplified in International Publication No. 2005/037967 Pamphlet.

The content of the ashless friction modifier in the lubricating oil composition of the present invention is preferably 0.01 percent by mass or more, more preferably 0.1 percent by mass or more, more preferably 0.3 percent by mass or more and preferably 3 percent by mass or less, more preferably 2 percent by mass or less, more preferably 1 percent by mass or less. If the content of the ashless friction modifier is less than 0.01 percent by mass, the friction reducing effect achieved thereby would tend to be insufficient. If the content is more than 3 percent by mass, the ashless friction modifier would tend to inhibit anti-wear additives from exhibiting their effects or deteriorate the dissolubility thereof. The ashless friction modifier is preferably used as a friction modifier.

If necessary, the lubricating oil composition of the present invention may be blended with any additives that have been generally used in a lubricating oil depending on the purposes in order to further enhance the properties. Examples of such additives include metallic detergents, ashless dispersants, anti-oxidants, antiwear agents (or extreme pressure additive), corrosion inhibitors, rust inhibitors, pour point depressants, demulsifiers, metal deactivators, and anti-foaming agents.

Examples of the metallic detergents include normal salts, basic salts and overbased salts of alkali metal sulfonates or alkaline earth metal sulfonates, alkali metal phenates or alkaline earth metal phenates, and alkali metal salicylates or alkaline earth metal salicylates. In the present invention, preferred are one or more alkali metal or alkaline earth metal detergent selected from these compounds, and particularly preferred are alkaline earth metal detergents. In particular, magnesium salts and/or calcium salts are preferred, and calcium salts are more preferred.

The ashless dispersant may be any ashless dispersant that is usually used for a lubricating oil. Examples of the ashless dispersant include mono- or bis-succinimides having in their molecules at least one straight-chain or branched alkyl or alkenyl group having 40 to 400 carbon atoms, benzylamines having in their molecules at least one alkyl or alkenyl group having 40 to 400 carbon atoms, polyamines having in their molecules at least one alkyl or alkenyl group having 40 to 400 carbon atoms, and boron-, carboxylic acid-, and phosphoric acid-modified products thereof. Any one or more of these ashless dispersants may be blended.

The anti-oxidant may be an ashless anti-oxidant such as a phenol- or amine-based anti-oxidant, or a metallic anti-oxidant such as a copper- or molybdenum-based anti-oxidant. Specific examples of the phenol-based anti-oxidant include 4,4'-methylene bis(2,6-di-tert-butylphenol) and 4,4'-bis(2,6-di-tert-butylphenol). Specific examples of the amine-based anti-oxidant include phenyl-α-naphthylamine; and dialkyldiphenylamines.

The antiwear agent (or extreme pressure additive) may be any anti-oxidant or extreme pressure additive that has been used for lubricating oil. For example, sulfuric-, phosphoric- and sulfuric-phosphoric extreme pressure additives may be used. Specific examples include phosphorus acid esters, thiophosphorus acid esters, dithiophosphorus acid esters, trithiophosphorus acid esters, phosphoric acid esters, thiophosphoric acid esters, dithiophosphoric acid esters, trithiophosphoric acid esters, amine salts, metal salts or derivatives thereof, dithiocarbamates, zinc dithiocaramates, molybdenum dithiocarbamates, disulfides, polysulfides, and sulfurized fats and oils. Among these antiwear agents, preferred are sulfuric extreme pressure additives, and particularly preferred are sulfurized fats and oils.

Examples of the corrosion inhibitor include benzotriazole-, tolyltriazole-, thiadiazole-, and imidazole-types compounds.

Examples of the rust inhibitor include petroleum sulfonates, alkylbenzene sulfonates, dinonylnaphthalene sulfonates, and alkenyl succinic acid esters.

The pour point depressant may be a poly(meth)acrylate polymer that conforms to a lubricating base oil to be used.

Examples of the demulsifier include polyalkylene glycol-based non-ionic surfactants such as polyoxyethylenealkyl ethers, polyoxyethylenealkylphenyl ethers, and polyoxyethylenealkylnaphthyl ethers.

Examples of the metal deactivator include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile.

Examples of the anti-foaming agent include silicone oil with a 25° C. kinematic viscosity of 1000 to 100,000 $mm^2/s$, alkenylsuccinic acid derivatives, esters of polyhydroxy aliphatic alcohols and long-chain fatty acids, aromatic amine salts of methylsalicylate and o-hydroxybenzyl alcohol.

When these additives are contained in the lubricating oil composition of the present invention, the anti-foaming agent is contained in an amount of 0.0005 to 1 percent by mass and the other additives are contained in an amount of 0.01 to 10 percent by mass on the total composition mass basis.

The 100° C. kinematic viscosity of the lubricating oil composition of the present invention is necessarily 2.5 $mm^2/s$ or higher and 5.2 $mm^2/s$ or lower, preferably 4.6 $mm^2/s$ or lower, more preferably 4.1 $m^2/s$ or lower, more preferably 3.8 $mm^2/s$ or lower, most preferably 3.5 $mm^2/s$ or lower. The 100° C. kinematic viscosity of the lubricating oil composition of the present invention is preferably 2.9 $mm^2/s$ or higher, more preferably 3.1 $mm^2/s$ or higher. The 100° C. kinematic viscosity used herein refers to the 100° C. kinematic viscosity determined in accordance with ASTM D-445. If the 100° C. kinematic viscosity is lower than 2.5 $mm^2/s$, the resulting composition would lack lubricity. If the 100° C. kinematic viscosity is higher than 5.2 $mm^2/s$, the resulting composition would fail to attain the required low temperature viscosity or a sufficient fuel economy.

The viscosity index of the lubricating oil composition of the present invention is necessarily within the range of 150 to 400, preferably 200 or greater, more preferably 250 or greater, more preferably 300 or greater. If the lubricating oil composition of the present invention has a viscosity index of less than 150, it would be difficult to improve the fuel economy, keeping 150° C. HTHS viscosity. If the lubricating oil composition of the present invention has a viscosity index of greater than 400, it would be degraded in evaporability and cause malfunctions due to the lack of dissolubility of additives and incompatibility with seal materials.

The 80° C. HTHS viscosity of the lubricating oil composition of the present invention is preferably 4.1 mPa·s or lower, more preferably 3.7 mPa·s or lower, more preferably 3.2 mPa·s or lower, particularly preferably 3 mPa·s or lower. The 80° C. HTHS viscosity is preferably 2 mPa·s or higher. The 80° C. HTHS viscosity referred herein denotes the high temperature high shear viscosity at 80° C. defined in accordance with ASTM D4683. The 80° C. HTHS viscosity represents the resistance caused by the viscosity of an engine oil in an engine, and lower the viscosity is, higher the fuel economy of the engine oil is. However, if the 80° C. HTHS viscosity is lower than 2 mPa·s, the resulting composition would lack lubricity. If the 80° C. HTHS viscosity is higher than 4.1 mPa·s, the resulting composition would not attain the required low temperature viscosity or a sufficient fuel economy.

The 150° C. HTHS viscosity of the lubricating oil composition of the present invention is preferably 1.4 mPa·s or higher, more preferably 1.42 mPa·s or higher. The 150° C. HTHS viscosity is preferably 3.0 mPa·s or lower, more preferably 2.8 mPa·s or lower.

The 150° C. HTHS viscosity referred herein denotes the high temperature high shear viscosity at 150° C. defined by ASTM D4683. The 150° C. high-shear viscosity represents the viscosity needed when an engine rotates at a high speed. If the 150° C. HTHS viscosity is lower than 1.4 mPa·s, the resulting composition would lack lubricity, possibly causing the durability of the engine to deteriorate drastically. If the 50° C. HTHS viscosity exceeds 3.5 mPa·s, the resulting composition would not attain the required low temperature viscosity or a sufficient fuel economy.

The lubricating oil composition of the present invention has a 150° C. HTHS viscosity (Vs) and 80° C. HTHS viscosity (Vk) ratio (Vs/Vk) of necessarily 0.35 or greater. The Vs/Vk is preferably 0.39 or greater, more preferably 0.44 or greater, more preferably 0.48 or greater. The Vs/Vk is preferably 0.60 or lower, more preferably 0.55 or lower. If the Vs/Vk is lower than 0.35, the 80° C. HTHS viscosity would not decrease sufficiently and an effect of enhancing the fuel economy cannot be obtained.

The flash point of the lubricating oil composition of the present invention is preferably 150° C. or higher, more preferably 160° C. or higher, and preferably 250° C. or lower. A too low flash point is not preferred because it increases the risk of ignition and the evaporation loss of the resulting composition. A flash point of 250° C. or higher results in a too high viscosity and the fuel saving effect cannot be seen.

No particular limitation is imposed on the NOACK evaporation loss of the lubricating oil composition of the present invention under a test condition of 250° C., which is, however, preferably 60 percent by mass or less, more preferably 40 percent by mass or less. The NOACK evaporation loss is preferably 5 percent by mass or more.

The NOACK evaporation loss under a test condition of 200° C. is 40 percent by mass or less, preferably 30 percent by mass or less, more preferably 25 percent by mass or less, more preferably 15 percent by mass or less, most preferably 10 percent by mass or less. The NOACK evaporation loss is preferably 5 percent by mass or more.

If the NOACK evaporation losses are the above-described lower values, it would be difficult to improve the low temperature viscosity characteristics. If the NOACK evaporation losses exceed the above-described upper limits, the lubricating oil composition would be large in the evaporation loss of the base oil when it is used in for an internal combustion engine and in connection with this facilitate catalyst poisoning.

The lubricating oil composition of the present invention is particularly useful for devices driving a generator. The use format is not regarded. For example, it may be used only for a single generator but also is useful for a system for driving a generator and an automobile. The composition is most suitably used exclusively for generating the electric power for an automobile.

No particular limitation is imposed on the fuel with which the lubricating oil composition is used if the fuel is used in a system for power generation. Therefore, the composition is suitably used in a gasoline engine, a diesel engine, or a gas engine. The fuel is preferably gasoline or gas oil, and most preferably gasoline.

EXAMPLES

The present invention will be described with reference to the following Examples and Comparative Examples but are not limited thereto.

Examples 1 to 3, Comparative Examples 1 to 3

The properties of the base oils used in Examples and Comparative Examples are set forth in Table 1. The carbon number distributions derived from gas chromatography distillation are set forth in Table 2.

In accordance with the formulations set forth in Table 3, the lubricating oil compositions (Example 1 to 3) of the present invention and lubricating oil compositions for comparison (Comparative Examples 1 to 3) were prepared. Various performance evaluation tests were carried out for each of the compositions, and the results thereof are set forth in Table 3.

TABLE 1

| | | Base oil 1 | Base oil 2 | Base oil 3 | Base oil 4 |
|---|---|---|---|---|---|
| Density | g/cm$^3$ | 0.798 | 0.812 | 0.831 | 0.832 |
| $\rho 15 \leq \rho$ | | satisfied | satisfied | not satisfied | not satisfied |
| Flash point (COC) | ° C. | 155 | 196 | 155 | 200 |
| Kinematic viscosity(40° C.) | mm$^2$/S | 5.20 | 9.08 | 9.34 | 13.46 |
| Kinematic viscosity(100° C.) | mm$^2$/S | 1.72 | 2.62 | 2.56 | 3.27 |
| Viscosity index | | 93 | 126 | 102 | 112 |
| Pour point | ° C. | <−45 | −32.5 | −27.5 | −22.5 |
| Aniline point | ° C. | 102 | 112 | 102 | 109 |
| Sulfur content | massppm | <1 | <1 | <1 | <1 |
| Nitrogen content | massppm | <3 | <3 | <3 | <3 |
| n-d-M analysis | % $C_P$ | | 90.6 | 68.2 | 72.6 |
| | % $C_N$ | | 9.4 | 31.8 | 27.4 |
| | % $C_A$ | | 0 | 0 | 0 |
| Chromatography separation mass % | Saturate content | 99.6 | 98.2 | 96.4 | 99.6 |
| | Aromatic content | 0.2 | 0.9 | 3.4 | 0.3 |
| | Resin content | 0.2 | 0.9 | 0.2 | 0.1 |
| NOACK evaporation loss (250° C., 1 h) | mass % | 100 | 43 | 60 | 35 |
| NOACK evaporation loss (200° C., 1 h) | mass % | 7 | 9 | 19 | 8 |

TABLE 2

| Carbon number | Base oil 1 | Base oil 2 | Base oil 3 | Base oil 4 |
|---|---|---|---|---|
| 10 | 0.0 | 0.0 | 0.0 | 0.0 |
| 11 | 0.1 | 0.0 | 0.0 | 0.0 |
| 12 | 0.0 | 0.0 | 0.1 | 0.0 |
| 13 | 0.1 | 0.0 | 0.3 | 0.0 |
| 14 | 0.0 | 0.0 | 1.0 | 0.0 |
| 15 | 0.0 | 0.0 | 2.0 | 0.0 |
| 16 | 0.0 | 0.2 | 3.6 | 0.1 |
| 17 | 0.3 | 1.0 | 5.9 | 0.5 |
| 18 | 5.4 | 2.2 | 6.9 | 1.1 |

TABLE 2-continued

| Carbon number | Base oil 1 | Base oil 2 | Base oil 3 | Base oil 4 |
|---|---|---|---|---|
| 19 | 55.7 | 4.0 | 7.6 | 2.5 |
| 20 | 35.5 | 7.5 | 8.1 | 5.0 |
| 21 | 1.1 | 13.7 | 8.7 | 8.0 |
| 22 | 0.3 | 20.5 | 9.5 | 11.7 |
| 23 | 0.2 | 21.9 | 10.9 | 15.6 |
| 24 | 0.1 | 17.3 | 11.8 | 18.6 |
| 25 | 0.2 | 8.4 | 9.4 | 16.8 |
| 26 | 0.3 | 2.6 | 6.0 | 11.6 |
| 27 | 0.5 | 0.6 | 3.3 | 5.6 |
| 28 | 0.2 | 0.1 | 1.7 | 1.9 |
| 29 | 0.0 | 0.0 | 0.9 | 0.6 |
| 30 | 0.0 | 0.0 | 0.6 | 0.2 |
| 31 | 0.0 | 0.0 | 0.4 | 0.1 |
| 32 | 0.0 | 0.0 | 0.3 | 0.1 |
| 33 | 0.0 | 0.0 | 0.2 | 0.0 |
| 34 | 0.0 | 0.0 | 0.2 | 0.0 |
| 35 | 0.0 | 0.0 | 0.2 | 0.0 |
| 36 | 0.0 | 0.0 | 0.1 | 0.0 |

TABLE 2-continued

| Carbon number | Base oil 1 | Base oil 2 | Base oil 3 | Base oil 4 |
|---|---|---|---|---|
| 37 | 0.0 | 0.0 | 0.1 | 0.0 |
| 38 | 0.0 | 0.0 | 0.1 | 0.0 |
| 39 | 0.0 | 0.0 | 0.1 | 0.0 |
| 40 | 0.0 | 0.0 | 0.0 | 0.0 |
| Total | 100.0 | 100.0 | 100.0 | 100.0 |
| C10-C24 (CA) | 98.8 | 88.3 | 76.4 | 63.1 |
| C25-C40 (CB) | 1.2 | 11.7 | 23.6 | 36.9 |
| CA/CB | 82.33 | 7.55 | 3.24 | 1.71 |
| C16 or fewer | 0.2 | 0.2 | 7.0 | 0.1 |
| C18 or fewer (CC) | 5.9 | 3.4 | 19.8 | 1.7 |
| C20 or fewer | 97.1 | 14.9 | 35.5 | 9.2 |
| C17 or more | 99.8 | 99.8 | 93.0 | 99.9 |
| C19 or more (CD) | 94.1 | 96.6 | 80.2 | 98.3 |
| C21 or more | 2.9 | 85.1 | 64.5 | 90.8 |
| CC/CD | 0.06 | 0.04 | 0.25 | 0.02 |

TABLE 3

| | | Example 1 | Example 2 | Example 3 | Comparative Example 1 | Comparative Example 2 | Comparative Example 3 |
|---|---|---|---|---|---|---|---|
| Base Oil on the total base oil mass basis | | | | | | | |
| Base oil 1 | in mass % | | (100) | | | | |
| Base oil 2 | in mass % | (100) | | (100) | | (100) | |
| Base oil 3 | in mass % | | | | | | (100) |
| Base oil 4 | in mass % | | | | (100) | | |
| Additives on the total composition mass basis | | | | | | | |
| Viscosity index improver 1 | mass % | 5.5 | | | | | |
| Viscosity index improver 2 | mass % | | 11.5 | 2.9 | | | |
| Viscosity index improver 3 | mass % | | | | | 1.0 | 0.5 |
| Additive package | mass % | 10.3 | 10.3 | 10.3 | 10.3 | | |
| Evaluation results | | | | | | | |
| Kinematic viscosity (40° C.) | $mm^2/s$ | 13.2 | 9.8 | 13.1 | 16.6 | 14.5 | 14.9 |
| Kinematic viscosity (100° C.) | $mm^2/s$ | 3.73 | 3.30 | 3.65 | 3.81 | 3.92 | 3.85 |
| Viscosity index | | 220 | 334 | 186 | 129 | 180 | 145 |
| HTHS viscosity | | | | | | | |
| 80° C. Vk | mPa · s | 3.5 | 2.9 | 3.9 | 4.7 | 4.2 | 4.3 |
| 100° C. | mPa · s | 2.57 | 1.89 | 2.74 | 3.01 | 2.80 | 2.86 |
| 150° C. Vs | mPa · s | 1.41 | 1.40 | 1.41 | 1.45 | 1.41 | 1.42 |
| Vs/Vk | | 0.40 | 0.48 | 0.36 | 0.31 | 0.34 | 0.33 |
| Shear stability | % | 10 | — | 2 | — | — | — |
| SONIC method | | | | | | | |
| 10 kHZ, 28 μm, 10 min, 60 ml, 3.9 V | | | | | | | |
| Viscosity reduction rate 100° C. | | | | | | | |
| Diesel injector method | % | 9 | — | 1 | — | — | — |
| ASTM3945A | | | | | | | |
| Viscosity reduction rate 100° C. | | | | | | | |
| Flash point (COC) | ° C. | 198 | — | 196 | — | 196 | 160 |
| Evaporation properties | wt % | 9 | 7 | 9 | 8 | 9 | 19 |
| NOACK (200° C.) | | | | | | | |
| Evaporation properties | wt % | 35 | — | 35 | — | 35 | 50 |
| NOACK (250° C.) | | | | | | | |
| Detergent properties | | 5 | — | 5 | — | — | — |
| HTT test after NOACK evaporation | | | | | | | |
| 280° C. evaluation point | | | | | | | |

Viscosity index improver 1: Non-dispersant type polymethacrylate (weight-average molecular weight = 380,000, PSSI = 25, Mw/PSSI = 1.52 × 104) $R^2$ composition: carbon number 1 75 mol %, carbon number 16 10 mol %, carbon number 18 5 mol %, carbon number 22 10 mol %

Viscosity index improver 2: Non-dispersant type polymethacrylate (weight-average molecular weight = 380,000, PSSI = 25, Mw/PSSI = 1.52 × 104) $R^2$ composition: carbon number 1 70 mol %, carbon number 16 10 mol %, carbon number 18 5 mol %, carbon number 22 10 mol %

Viscosity index improver 3: Dispersant type polymethacrylate (weight-average molecular weight = 400,000, PSSI = 50, Mw/PSSI = 0.8 × 104) $R^2$ composition: carbon number 1 60 mol %, carbon number 12 10 mol %, carbon number 13 5 mol %, carbon number 14 10 mol %, carbon number15 10 mol %

Additive package: package for engine oil containing, ZnDTP anti-wearagent, Ca metallic detergent, ashless dispersant, MoDTC, and anti-foaming agent

INDUSTRIAL APPLICABILITY

The lubricating oil composition of the present invention can retain the durability of an engine, exhibiting a significantly improved fuel economy and is particularly useful as a lubricating oil composition for driving a generator.

The invention claimed is:

1. A lubricating oil composition comprising (A) a hydrocarbon base oil having a ratio (CA/CB) of proportion of component of 24 or fewer carbon atoms (CA) and proportion of component of 25 or more carbon atoms (CB) in carbon number distribution obtained by gas chromatography distillation of 2.0 or higher, the composition having a ratio (Vs/Vk) of 80° C. high-temperature high-shear (HTHS) viscosity (Vk) and 150° C. HTHS viscosity (Vs) of 0.35 or higher and a 100° C. kinematic viscosity of 2.5 $mm^2/s$ or higher and lower than 5.2 $mm^2/s$ wherein the hydrocarbon base oil is a mineral base oil selected from (a) a hydrocarbon base oil produced by subjecting a lubricating oil fraction produced by atmospheric- and/or vacuum-distillation of a crude oil to one or more refining processes selected from solvent deasphalting, solvent extraction, hydrocracking, solvent dewaxing, catalytic dewaxing, hydrorefining, sulfuric acid treatment, and clay treatment, and (b) a synthetic base oil selected from poly-α-olefins and hydrogenated compounds thereof, isobutene oligomers and hydrogenated compounds thereof, paraffins, alkylbenzenes, and alkyl naphthalenes.

2. The lubricating oil composition according to claim 1, further comprising (B) a viscosity index improver having a ratio of weight-average molecular weight and PSS of $1.2\times10^4$ or greater.

3. The lubricating oil composition according to claim 1, wherein the composition is an engine oil for a generator.

4. The lubricating oil composition according to claim 2, wherein the composition is an engine oil for a generator.

* * * * *